United States Patent [19]

Close

[11] Patent Number: 5,072,213

[45] Date of Patent: Dec. 10, 1991

[54] SENSOR FOR MERCHANDISE SECURITY SYSTEM

[75] Inventor: Leo R. Close, Sepulveda, Calif.

[73] Assignee: Marcia Israel, Van Nuys, Calif.

[21] Appl. No.: 504,117

[22] Filed: Apr. 3, 1990

Related U.S. Application Data

[63] Continuation-in-part of Ser. No. 308,771, Feb. 9, 1989, Pat. No. 4,962,369.

[51] Int. Cl.[5] ..... G08B 13/02

[52] U.S. Cl. ..... 340/572; 200/329; 200/341; 340/568; 340/693

[58] Field of Search ..... 340/568, 571, 572, 687, 340/652, 693; 200/329, 341, 51 R, 61.41

[56] References Cited

U.S. PATENT DOCUMENTS 4,253,084 2/1981 Toppute ..... 340/568

4,620,182 10/1986 Keifer ..... 340/568

*Primary Examiner*—Glen R. Swann, III

*Attorney, Agent, or Firm*—Spensley Horn Jubas & Lubitz

[57] ABSTRACT

A merchandise security system sensor encloses a microswitch operated by an overtravel actuator projecting from the sensor housing. The microswitch is adapted to be electrically connected to a monitoring system which generates an alarm signal in response to a change of state of the microswitch. Attachment of the sensor to a protected article operates to depress the microswitch actuator and places the microswitch in a first state. Unauthorized removal of the sensor from the article releases the actuator causing the microswitch to revert to its initial state thereby triggering the alarm.

12 Claims, 4 Drawing Sheets

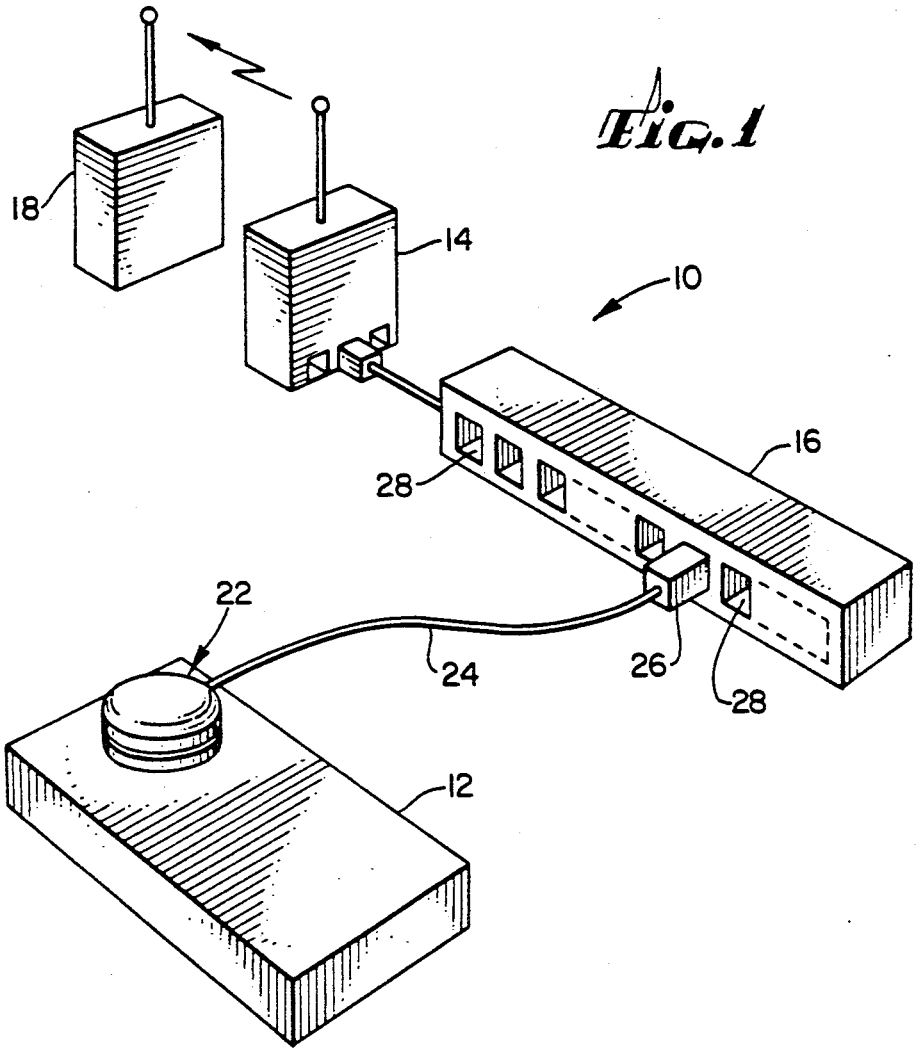
FIG. 1
FIG. 2
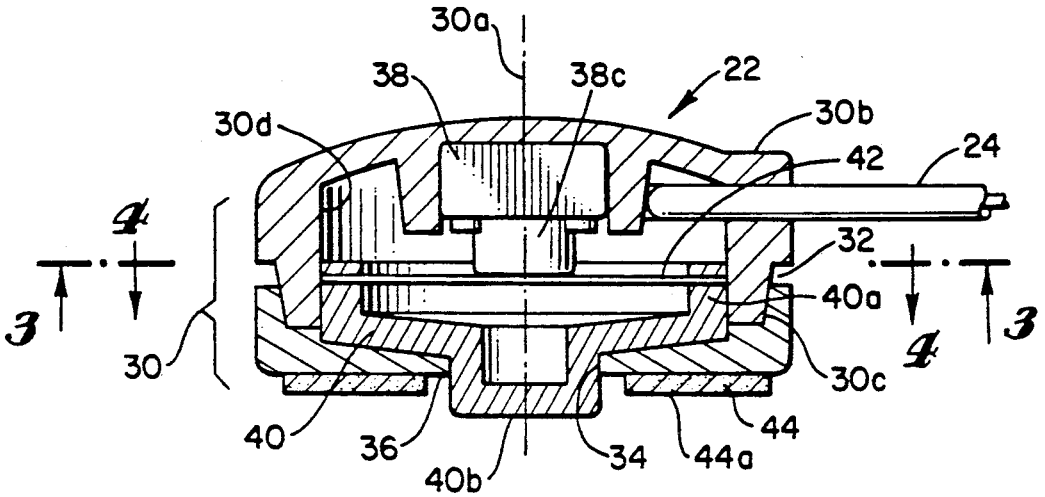

SENSOR FOR MERCHANDISE SECURITY SYSTEM

CROSS REFERENCES TO RELATED APPLICATIONS

This application is a continuation-in-part of application Ser. No. 308,771, filed Feb. 9, 1989, for "Merchandise Security System Utilizing RF Transmitter" now U.S. Pat. No. 4,962,369, issued Oct. 9, 1990, and is related to application Ser. No. 902,484, now U.S. Pat. No. 4,746,909 issued May 24, 1988, for "Modular Security System", which is incorporated by reference.

FIELD OF THE INVENTION

The invention relates generally to electronic security systems for protecting display merchandise, and more particularly to security systems employing a sensor attachable to an article of merchandise and adapted to activate an alarm in the event the sensor is detached from the article or its connection otherwise broken.

BACKGROUND OF THE INVENTION

Expensive merchandise such as electronic equipment on display in retail stores is presently protected against theft in various ways. One common approach to safeguarding "hard goods" such as tape players, cameras, stereos, and the like, is to simply keep them inside a display case. This requires sales personnel to be present to open the display case and remove an article for the customer's examination. Alternatively, samples of merchandise are mechanically secured by means of a mounting bracket or by a length of steel cable or chain. Such mechanical security systems are easily defeated by cutting the cable or chain or otherwise separating the article from its restraint. Moreover, these systems typically lack alarm devices for alerting store personnel to an attempted theft of protected merchandise.

While prior electrical security systems eliminate many of the disadvantages of mechanical systems, the inventor is not aware of any electrical system sensors capable of universal application. For example, a wire loop cannot be used if the article to be protected does not have a handle or other opening for receiving the loop. And, sensors designed to protect garments often cannot be applied to "hard goods," and vice versa.

SUMMARY OF THE INVENTION

In accordance with one specific, exemplary form of the invention there is provided a universal switch-type sensor adapted to be attached to an article to be safeguarded and which is associated with a security system having an alarm-activating circuit. The sensor includes a microswitch enclosed within a housing, the switch having an overtravel actuator in alignment with an opening in the housing and biased to a first position so as to place the switch in a first state. The switch is electrically connected to means for controlling the alarm-activating circuit in response to a change of state of the switch. The housing includes means for attaching the sensor to the article to be safeguarded, the switch actuator being moved to a second position to place the switch in a second state in response to attachment of the sensor to the article. The switch reverts to its first state in response to detachment of the sensor from the article.

In accordance with one embodiment of the invention, the sensor housing includes a flat, outer surface adjacent the opening in the housing and the means for attaching the sensor to the article comprises double-sided adhesive tape mounted on the outer surface of the housing.

In accordance with another exemplary form of the invention, the attaching means includes a cap removably mounted on the housing. An electrical conductor connected to the switch is looped and passed through openings in the cap, a portion of the conductor being thereby trapped between the cap and the switch actuator so that, with the cap in place, the actuator is sufficiently displaced by the trapped portion of the conductor to throw the switch to its second state. The loop formed by the electrical conductor has a variable length and is used to attach the sensor to the safeguarded article. The switch reverts to its first state in response to removal of the cap or withdrawal of the conductor from the cap. Thus, the same basic sensor may be applied to a surface of a "hard goods" item or secured by a conductive loop to an article having a handle or similar opening.

Although the sensor of the present invention may be used in combination with various alarm-activating systems responsive to the state of the switch, the sensor of the present invention is particularly suitable for use with the monitoring and alarm-activating systems disclosed in U.S. Pat. No. 4,746,909 and U.S. application Ser. No. 308,771. Those systems include multi-channel monitoring circuitry responsive to any change of state of the electrical connections thereto. Thus, for example, connection of a sensing means to the monitoring circuit, as well as disconnection or severing thereof, produces an alarm signal.

BRIEF DESCRIPTION OF THE DRAWINGS

The foregoing and other objects, features and advantages of the invention will be apparent from the following detailed description of preferred embodiments of the invention when read in conjunction with the accompanying drawings in which:

FIG. 1 is a perspective view of a merchandise security system, in schematic form, including a sensor in accordance with a first embodiment of the invention, the sensor being attached to a protected article of merchandise;

FIG. 2 is a side, elevation view, in section, of the sensor of FIG. 1 shown detached from the protected article;

DETAILED DESCRIPTION OF THE PREFERRED EMBODIMENTS

Figure 3:
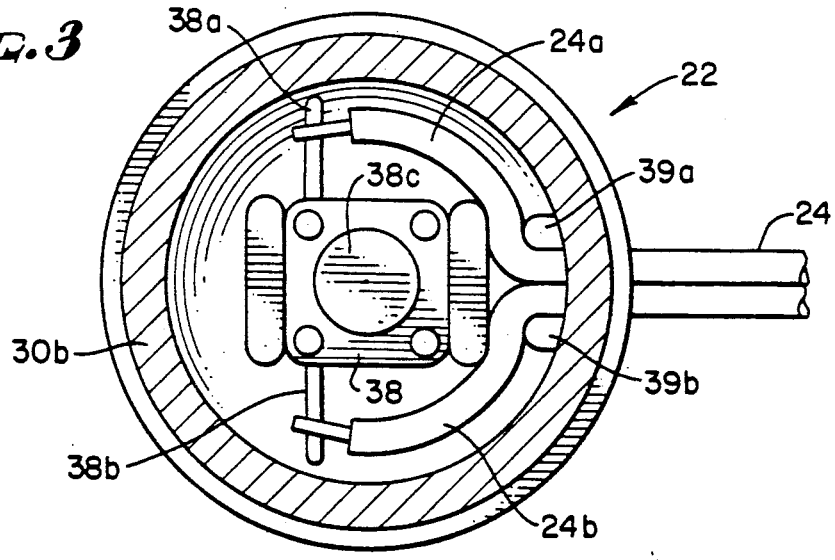
FIG. 3 is a plan view, in section, of the sensor shown in FIG. 2 as seen along the plane 3—3.
Figure 4:
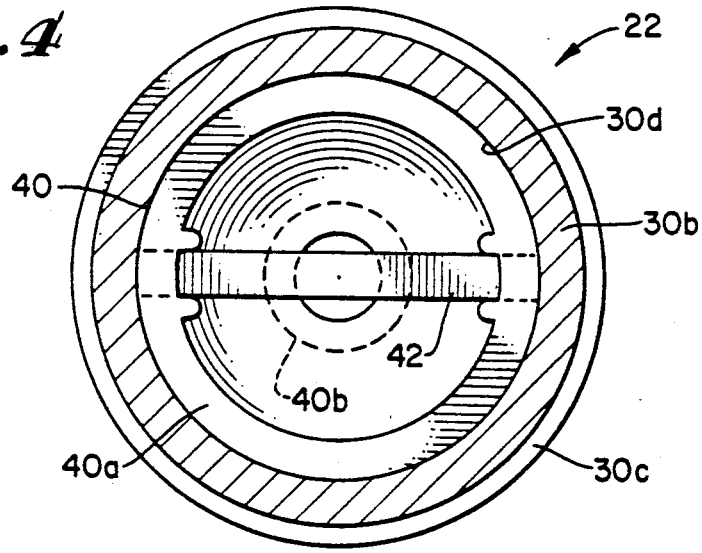
FIG. 4 is a plan view, in section, of the sensor shown in FIG. 2 as seen along the plane 4—4.

FIG. 1 shows in diagrammatic form the main components of a security system 10 for protecting a number of retail store display items such as an article 12. The system 10 includes a control unit 14 which may be shared by a plurality of multi-channel monitoring or manifold units one of which is identified by the reference numeral 16. The control unit 14 incorporates a transmitter for broadcasting a code modulated radio frequency (RF) signal in response to an alarm condition. A receiver 18 for detecting the RF signal generates an output which drives an alarm-indicating device such as a speaker.

Alternative forms of the system 10, as generally described to this point, are disclosed in detail in referenced U.S. Pat. Nos. 4,746,909 and 4,962,369. Basically, these systems monitor a plurality of sensors each of which is attachable to an article to be safeguarded. The sensor, which, by way of example, may take the form of a conductive wire loop, is coupled to a manifold unit 16 responsive to a change of state of the electrical connections thereto. Thus, connection of a sensor to a manifold unit or disconnection thereof or severing of the sensor loop produces a main alarm signal. Also as described in the incorporated patent and application, these systems further provide a "short", softer alarm to indicate an authorized disconnection or connection of a sensor. By "daisy-chaining" several manifold units 16, many articles can be protected by a single control unit and receiver combination.

In accordance with the present invention, a sensor 22 is attached to the article 12 and is coupled to the manifold unit 16 by an electrical cable 24 having a plug 26 received by one of a number of receptacles or jacks 28 on the manifold unit.

With reference now to FIGS. 2–5, the sensor 22 includes a generally cylindrical housing 30 centered on an axis 30*a* and having two parts, 30*b* and 30*c*, defining at their interface a circumferential groove 32. One wall of the housing part 30*c* has a central opening 34 coaxial with the axis 30*a* and surrounded by a substantially flat, outer housing surface 36.

Disposed within the housing 30 is a microswitch 38 having electrical terminals 38*a* and 38*b* and a push button or plunger 38*c* centered on the axis 30*a* and whose activation changes the state of the switch. Although it will be evident that alternative configurations may be used, the switch 38 may be simply a single pole single throw normally open switch which is closed in response to depression of the plunger 38*c*. The electrical cable 24 has two wire conductors 24*a* and 24*b* connected respectively to the terminals 38*a* and 38*b* of the switch. Strain relief is furnished by a pair of posts 39*a* and 39*b* about which the conductors are passed.

Figure 5:
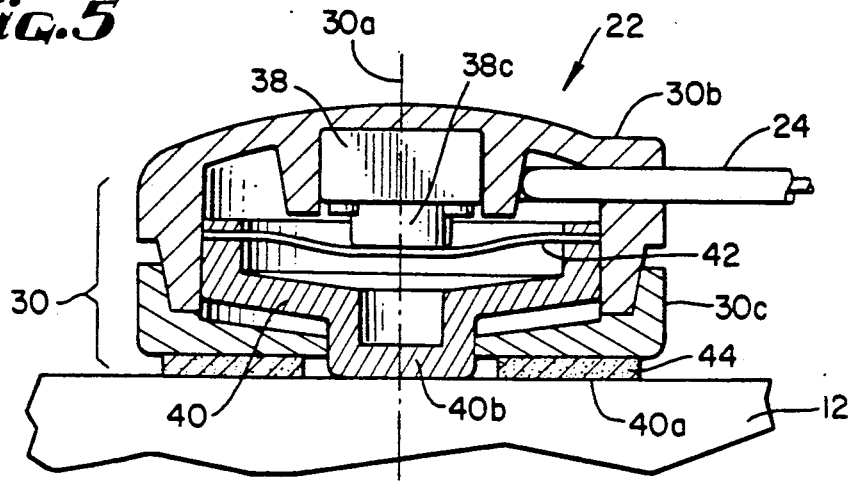
FIG. 5 is a side elevation view, in section, of the sensor of FIG. 2 shown attached to the protected article.

Also enclosed within the housing is a generally cylindrical, cup-like switch actuator 40 centered on the axis 30*a* and movable axially to operate the switch 38. The actuator 40 has an outer cylindrical skirt 40*a* in slidable contact with a cylindrical inner wall 30*d* of the housing and a central button 40*b* extending through the opening 34 and projecting below the surface 36. Spanning a diameter of the actuator skirt 40*a* is a leaf spring 42 having ends anchored at diametrically opposed points on the skirt 40*a*. The central portion of the leaf spring engages the switch plunger 38*c* and normally biases the button 40 to the position shown in FIG. 2. It will be seen that depressing the actuator button 40*b* operates the microswitch via the leaf spring 42. Further, the displacement of the button 40*b* can substantially exceed that of the microswitch plunger, the overtravel of the button 40*b* being accommodated by deflection of the leaf spring 42 (FIG. 5). The actuator 40 thus serves as a non-critical component for operating the microswitch whose plunger typically moves as little as several thousandths of an inch to change the state of the switch.

The sensor 22 may be conveniently attached to a surface of the protected article 12 by double-sided adhesive tape 44 one side of which is applied to the outer surface 36 of the sensor housing 30 and the other side 44*a* of which adheres to the article as shown in FIG. 5. With reference to FIG. 2, the plunger 38*c* projects substantially beyond the surface 44*a* of the tape so that attachment of the sensor to the article depresses the microswitch plunger sufficiently to change the state of the switch, that is, to close the switch in the example under consideration and to thereby close the sensor loop as shown schematically in FIGS. 10 and 11.

Figure 6:
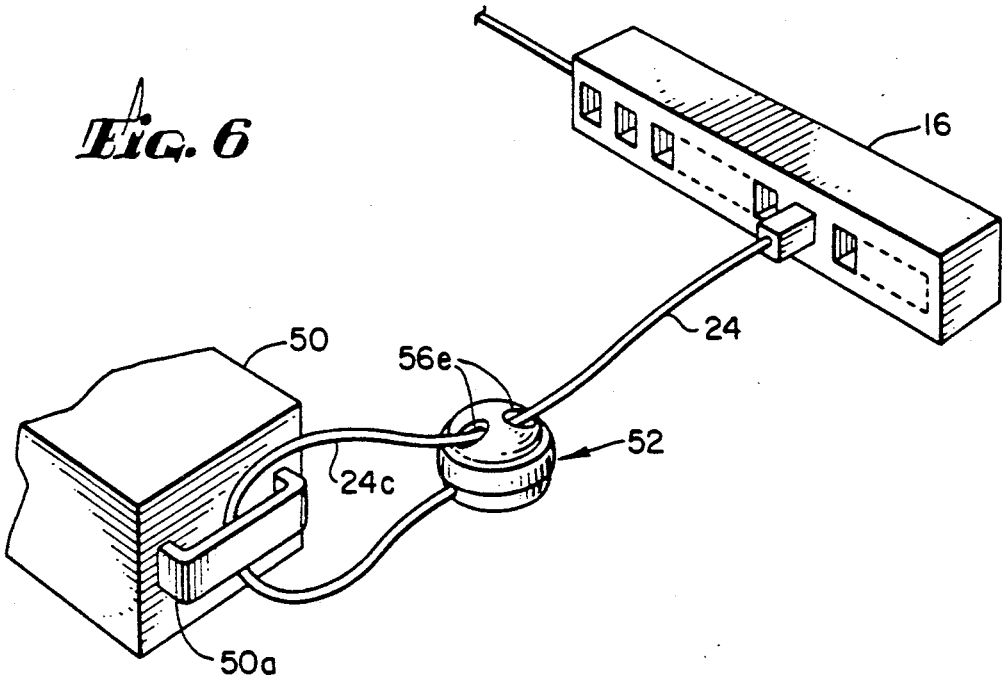
FIG. 6 is a perspective view of a merchandise security system, in schematic form, including a sensor in accordance with a second embodiment of the invention, with the sensor shown attached to a protected article.
Figure 7:
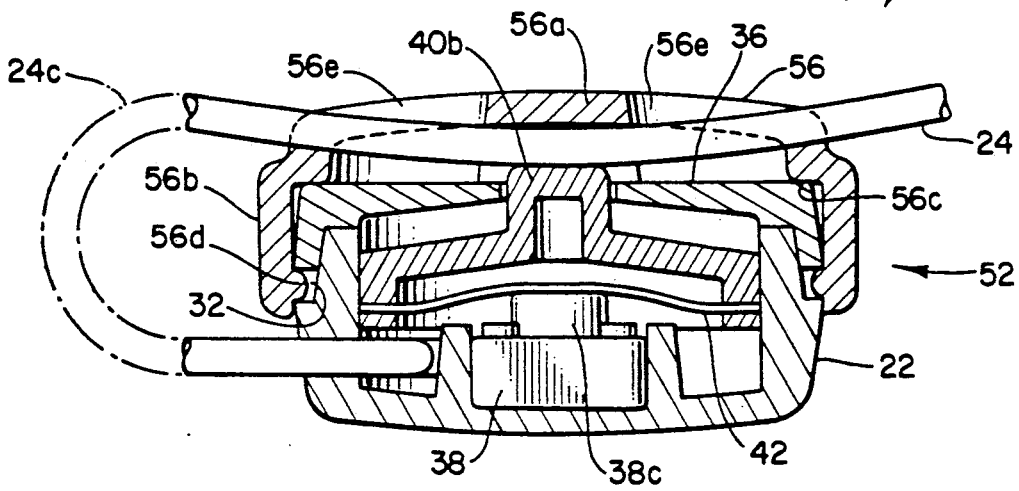
FIGS. 7 and 8 are side elevation views, in section, of the sensor of FIG. 6.
Figure 8:
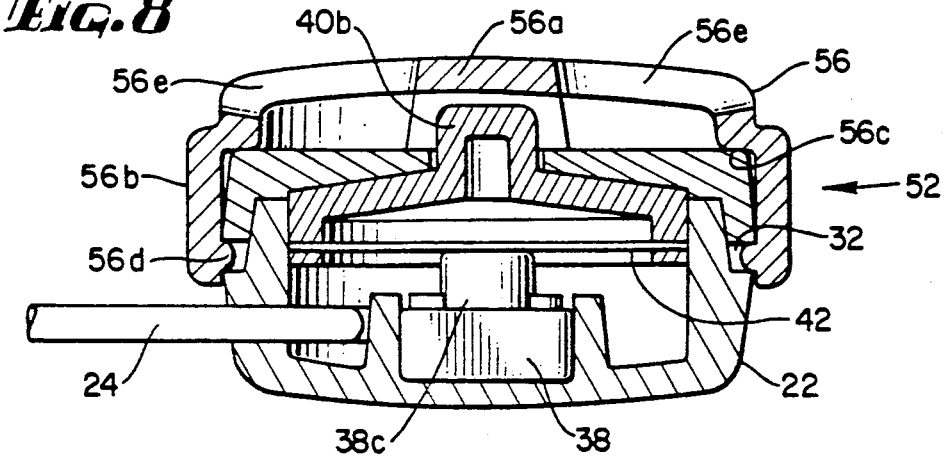

FIGS. 6–8 show an alternative arrangement utilizing the teachings of the invention in which an article 50 to be safeguarded has a handle 50*a* or the like for receiving a portion of the cable 24 formed into a closed loop 24*c*. The free end of the cable 24 is coupled to a manifold unit 16, as already described in connection with the first embodiment. A sensor assembly 52 used in this embodiment includes a sensor 22 identical to that already described except that in place of the adhesive strip 44 it is provided with a generally cylindrical, removable cap 56 with a generally horizontal end wall 56*a* disposed over and spaced from the surface 36 of the sensor housing. The cap has a generally cylindrical side wall 56*b* encircling the sensor housing. The cap also defines an internal annular shoulder 56*c* engaging the periphery of the surface 36 on the sensor housing and the side wall 56*b* has an inwardly projecting bead 56*d* received by the groove 32. The cap 56 further has diametrically opposed openings 56*e* in alignment with the button 40*b* through which openings the cable 24 is passed. A segment of the cable is thereby trapped inside the cap between the button 40*b* and the end wall 56*a* of the cap, and with the cap snapped in place on the housing as shown in FIG. 7, the trapped segment of the cable depresses the button 40*b* sufficiently to close the switch 38. The cable 24 is slideably retained by the cap to facilitate adjustment of the size of the loop 24*c*. With reference to FIG. 8, removal of the cable releases the button 40*b* thereby opening the switch 38 and generating an alarm signal in a manner already described. The alarm is similarly activated in response to severance of the cable.

Figure 9:
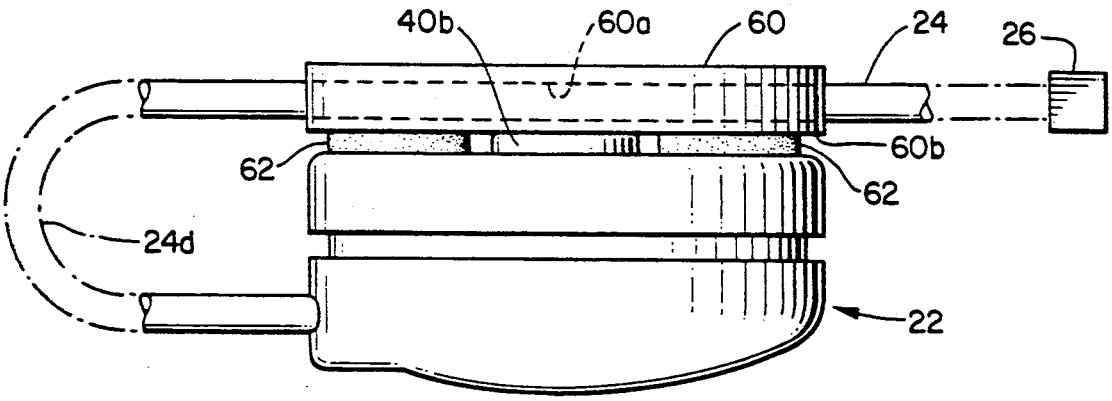
FIG. 9 is a side elevation view of yet another embodiment of the invention.

FIG. 9 shows yet another embodiment of the invention in which the sensor 22 is combined with a cap in the form of a disk 60 having a bore 60*a* along a diameter thereof for slideably receiving the cable 24. The sensor is attached to an article by passing it through a handle, or the like, on the article and securing it to a face 60*b* of the disk by means of double-sided adhesive material 62, along the lines already described, so as to depress the switch actuator button 40*b* and to form a variable length closed cable loop 24*d*. Removal of the disk 60 or severance of the cable 24 activates the alarm.

Figure 10:
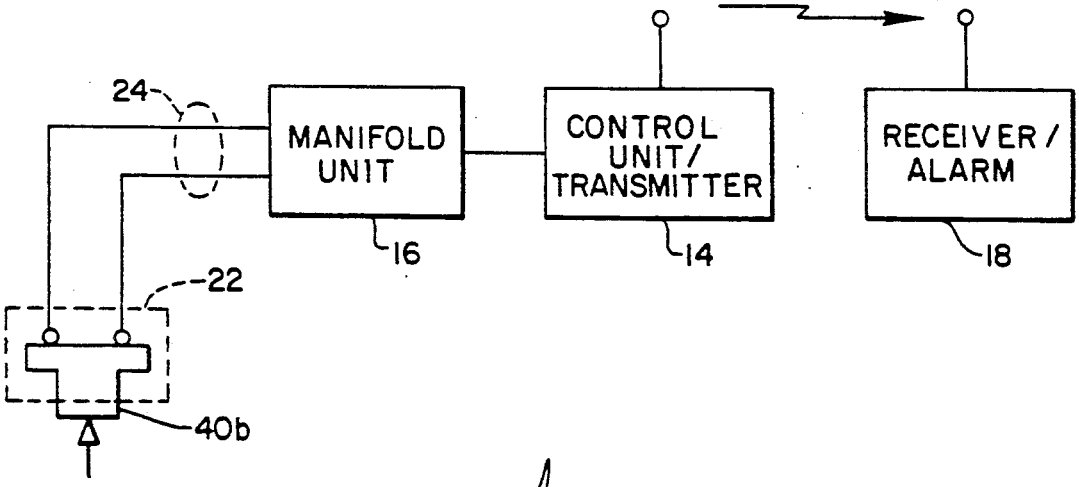
FIGS. 10 and 11 are block diagrams of security systems employing the teachings of the present invention.
Figure 11:
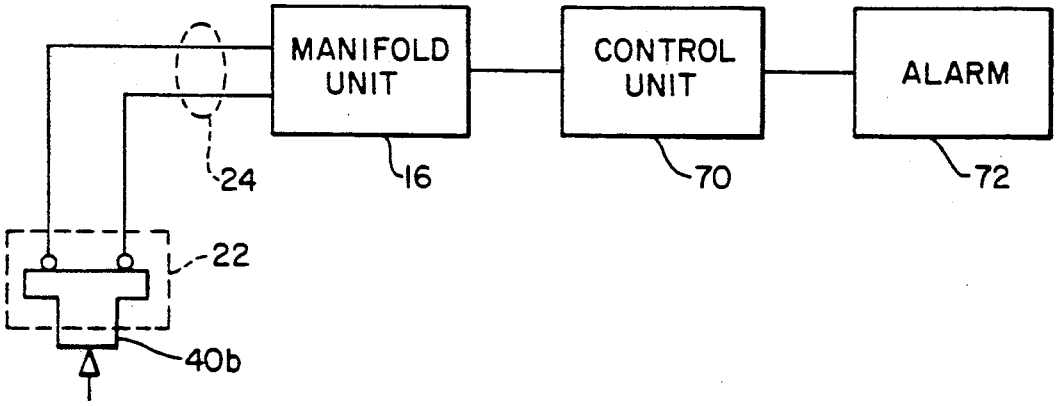

FIGS. 10 and 11 are block diagrams of two security systems utilizing the present invention and employing, respectively, the teachings of referenced U.S. Pat. No. 4,962,369 and U.S. Pat. No. 4,746,909.

In FIG. 10, sensor 22 is connected to the manifold unit 16 which in turn is coupled to a control unit 14 incorporating an RF transmitter. As shown schematically, the switch terminals of sensor 22 are closed as a result of actuation of the button 40*b*. Opening of the sensor switch or severance of the cable 24 energizes the transmitter thereby activating the alarm of the remote receiver/alarm unit 18.

The specific portions of U.S. Pat. No. 4,963,369 disclosing the details of the various parts of the system of FIG. 10 are as follows:

| | U.S. Pat. No. 4,962,369 |
|---|---|
| Manifold unit 16 | FIGS. 11, 12 and related description. |
| Control unit 14 | FIGS. 13A, 13B, 14 and related description. |
| Receiver/alarm 16 | FIG. 15 and related description. |

The system of FIG. 11, which includes a manifold unit 16 responsive to a sensor 22; a control unit 70; and a "local" alarm 72, does not employ radio transmission. Reference is made to the following portions of the incorporated U.S. Pat. No. 4,746,909 for details of the system of FIG. 11:

| | U.S. Pat. No. 4,746.909 |
|---|---|
| Manifold unit 16 | FIG. 6 and related description. |
| Control unit 70 and alarm 72 | FIGS. 7A, 7B and related description. |

what is claimed is:

1. A sensor for use in a security system for safeguarding display merchandise, the sensor comprising:

a housing having a wall with an opening therein, the housing having an outer surface extending about said opening;

a microswitch enclosed within the housing;

an overtravel actuator for operating the microswitch, the actuator being in alignment with said opening and biased to project therefrom; and means for attaching the sensor to an article of merchandise with the outer surface of the sensor proximate the surface of the article, thereby depressing the microswitch actuator and changing the state of the switch.

2. A sensor, as defined in claim 1, in which:

the attaching means comprises double-sided adhesive strip material.

3. A sensor, as defined in claim 1, in which:

the microswitch is a normally open switch and is closed in response to attachment of the sensor to the article.

4. A sensor, as defined in claim 1, in which:

the microswitch includes a plunger for operating the microswitch; and resilient means couples the actuator and the microswitch plunger, the travel of the actuator substantially exceeding the displacement of the plunger required to change the state of the microswitch, the resilient means compensating for the difference between the travel of the actuator and the displacement of the plunger.

5. A security system for safeguarding display merchandise, the system comprising:

a. a sensor including:

i. a housing having a wall with an opening therein, the housing having an outer surface extending about said opening;

ii. a microswitch enclosed within the housing, the switch having an overtravel actuator in alignment with said opening and biased to project therefrom; and iii. means for attaching the sensor to a surface of an article of merchandise with the outer surface of the sensor proximate the surface of the article, thereby depressing the microswitch actuator to change the state of the microswitch; and b. circuit means coupled to the microswitch and responsive thereto for activating an alarm in response to a change of state of said microswitch.

6. A security system, as defined in claim 5, in which:

the microswitch is releasably coupled to the circuit means by an electrical conductor, the alarm furthermore being activated in response to coupling the sensor to the circuit means, decoupling the sensor from the circuit means, or severing the electrical conductor.

7. A security system for safeguarding display merchandise, the system comprising:

a. a monitoring device including:

i. a housing having a removable cap;

ii. a switch mounted within the housing, the switch having a projecting actuator; and iii. an electrical conductor having one end connected to the switch, a portion of said conductor being slidably received between said cap and said switch actuator thereby depressing the actuator, the electrical conductor forming a variable length closed loop for attaching the monitoring device to an article of merchandise, removal of the cap or withdrawal of the conductor from the cap releasing the actuator and changing the state of the switch; and b. circuit means for activating an alarm, the other end of the electrical conductor being coupled to said circuit means, said alarm being activated in response to a change of state of said switch.

8. A security system, as defined in claim 7, in which:

the electrical conductor is releasably coupled to said circuit means, said alarm being furthermore activated in response to decoupling said electrical conductor from said circuit means, recoupling said conductor to said circuit means, or severance of the electrical conductor.

9. An article protection sensor for use with a security system having alarm-activating means, the sensor comprising:

a housing having an opening;

a microswitch enclosed within the housing, the microswitch having an overtravel actuator in alignment with the opening and biased to a first position placing the microswitch in a first state;

means connected to the microswitch for controlling the alarm-activating means in response to a change of state of the microswitch; and means operatively associated with the housing for attaching the sensor to an article to be protected, the switch actuator being moved to a second position to throw the microswitch to a second state in response to attachment of the sensor to the article, the microswitch reverting to its first state in response to detachment of the sensor from the article.

10. A sensor, as defined in claim 9, in which:

the housing has an outer surface adjacent the opening in the housing; and the means for attaching the sensor to the article comprises adhesive bonding means on the outer surface of the housing.

11. A sensor, as defined in claim 9, in which:

the controlling means includes an electrical conductor having one end connected to the microswitch and another end extending from the housing and adapted to be coupled to the alarm-activating means; and the attaching means includes a cap removably mounted on the housing, a portion of the conductor being trapped between the cap and the microswitch actuator to displace the actuator thereby throwing the switch to its second state, the electrical conductor forming a loop for attaching the sensor to an article to be protected, the microswitch reverting to its first state in response to removal of the cap or withdrawal of the conductor from the cap.

12. A sensor, as defined in claim 9, in which:

the controlling means includes an electrical conductor having one end connected to the microswitch and another end extending from the housing and adapted to be coupled to the alarm-activating means;

the housing has an outer surface adjacent the opening in the housing;

double-sided adhesive means having one side bonded to said outer surface; and the attaching means includes a cap having a surface adapted to be secured to the other side of the adhesive means, said cap having a bore for receiving a portion of said conductor, said conductor thereby being adapted to form a closed loop for attaching the sensor to the article, the microswitch reverting to its first state in response to removal of the cap from the housing.

* * * * *